US005899394A

United States Patent [19]

Folsberg

[11] Patent Number: 5,899,394

[45] Date of Patent: May 4, 1999

[54] RING ROLLER MILL

[75] Inventor: Jan Folsberg, Valby, Denmark

[73] Assignee: F. L. Smidth & Co. A/S, Denmark

[21] Appl. No.: 08/945,600

[22] PCT Filed: May 29, 1996

[86] PCT No.: PCT/DK96/00227

§ 371 Date: Oct. 28, 1997

§ 102(e) Date: Oct. 28, 1997

[87] PCT Pub. No.: WO97/02093

PCT Pub. Date: Jan. 23, 1997

[30] Foreign Application Priority Data

Jul. 4, 1995 [DK] Denmark ..... 0783/95

[51] Int. Cl.[6] ..... B02C 19/00; B02C 17/18

[52] U.S. Cl. ..... 241/29; 241/30; 241/103; 241/122; 241/181

[58] Field of Search ..... 241/103, 121, 241/122, 299, 181, 183, 29, 30

[56] References Cited

U.S. PATENT DOCUMENTS

| | | | |
|---|---|---|---|
| 704,650 | 7/1902 | Maxwell | 241/108 |
| 2,258,392 | 10/1941 | Piper | 241/143 |
| 2,656,985 | 10/1953 | Backlund et al. | 241/46.013 |
| 4,009,834 | 3/1977 | Hahn et al. | 241/27 |
| 4,032,314 | 6/1977 | Coggin, Jr. | 65/496 |
| 4,746,069 | 5/1988 | Entrikin et al. | 241/27 |
| 5,011,087 | 4/1991 | Richardson et al. | 241/5 |
| 5,205,494 | 4/1993 | Durinck et al. | 241/30 |
| 5,482,217 | 1/1996 | Schonert et al. | 241/24.1 |
| 5,543,037 | 8/1996 | Hering, Jr. | 210/104 |
| 5,716,015 | 2/1998 | Folsberg | 241/47 |

FOREIGN PATENT DOCUMENTS

| | | | |
|---|---|---|---|
| 1191110 | 11/1985 | Russian Federation | 241/299 |
| 1212570 | 2/1986 | Russian Federation | 241/30 |

*Primary Examiner*—Joseph J. Hail, III
*Assistant Examiner*—Susan Kingsbury
*Attorney, Agent, or Firm*—Baker & Botts, L.L.P.

[57] ABSTRACT

A method for grinding of material in a ring roller mill having at least one grinding ring, at least one roller fitted in the grinding ring and at least one unit fitted between the roller and the grinding ring. The method includes the steps of operating the mill at a subcritical speed and at a grinding pressure above 40 MPa, placing the unit in the path where compacted material is released from the ring at a certain distance from a point P, which is the point on the ring where the material is released, in such a way that the unit is hit by agglomerates formed during operation at an angle between 60° and 120°, said angle being between the surface of the unit and the direction of incidence of the material, after the latter is released from the grinding ring, and that the loosened material is distributed over the draw-in-zone in front of the roller and over the roller.

9 Claims, 3 Drawing Sheets

RING ROLLER MILL

Figure 1:
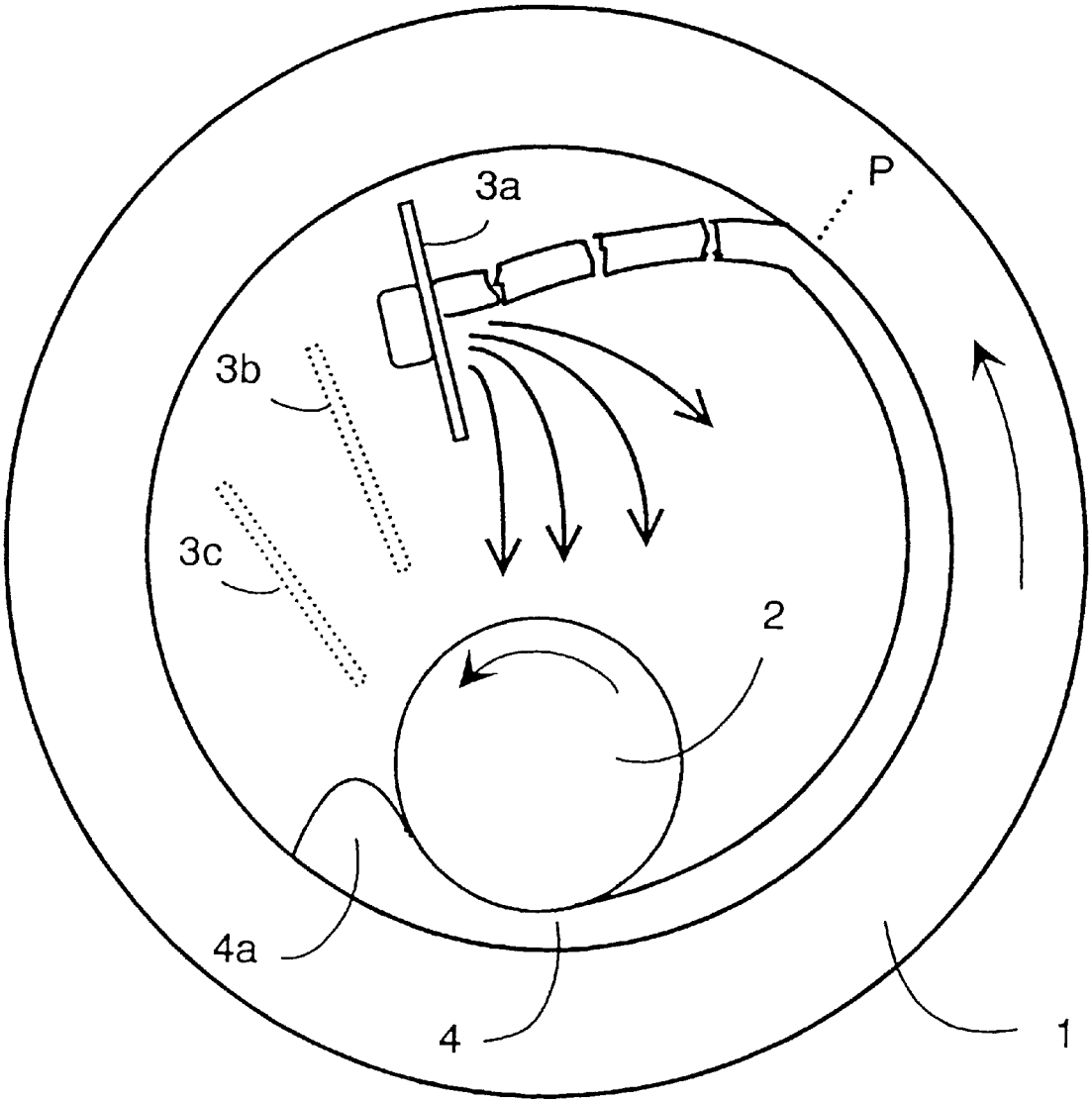

The present invention relates to a method for grinding of material in a ring roller mill which mill comprises at least one grinding ring, at least one roller fitted inside the grinding ring and at least one unit fitted between the roller and the grinding ring.

Such a mill can, for example, be used in connection with the manufacture of cement for grinding of mineral clinker materials, slag, and similar materials.

In the published European patent application No. 486371 a ring roller mill is described. In this mill the feed material is charged to a space before the grinding path where it is subjected to centrifuging action. Hereafter the material and the air are carried axially through the mill. The grinding ring in this mill operates at grinding pressure between 10–40 MPa and at supercritical speed, which means that the material subjected to grinding action is retained on the grinding ring all the way round. It is, therefore, possible and necessary to fit scrapers and guiding plates internally in the ring in order to release the material during the passage transversely to the grinding ring and to guide the material forward along the roller in the flow direction.

In a ring roller mill which is operated at subcritical speed, the ground material will only be retained on a part of the grinding ring. In an area on the grinding ring, dependent on the rotational speed of the ring, the surface roughness of the ring and the characteristics of the processed material, the ground material will be detached from the ring, continuing to fall along a downward path towards a draw-in zone in front of the roller.

An even distribution of the material in the draw-in zone and in the grinding bed is of major significance for the operation of the mill. Major variations in the thickness of the grinding bed will cause irregular operation or vibrations in the mill and substantial fluctuations in the torque of the drive arrangement. An uneven loading of the roller may also cause the wear segments which protect the surface of the grinding ring and the roller to be damaged.

The intensity of grinding pressure applied and the type of material being ground are determining factors in regard to the form that the compacted material will have after its passage under the roller in the mill. A high grinding pressure and/or sticky material will lead to formation of agglomerates which retain their form after the material is discharged from the grinding ring, whereas a lower grinding pressure will result in the dropping material being a relatively loose, crumbling material. Both the size and hardness of the agglomerates will have an effect on the evening-out of the bed of material which is deposited in the draw-in zone and in the grinding bed proper.

A ring roller mill operating at subcritical speed has a lower rate of rotation than a ring roller mill operating at supercritical speed. In order to increase the production in a mill operating at subcritical speed to the same level as in a similar mill operating at supercritical speed it is necessary to increase the grinding pressure. Normally the grinding pressure in a mill operated at subcritical speed will be higher than 50 MPa.

It is the objective of the present invention to provide a method for grinding of material in a ring roller mill where the agglomerates formed during operation are crushed and distributed along the draw-in zone and the roller in such a way that no undesirable vibrations or skew placement of the roller occur during operation.

This is achieved according to the invention in a surprisingly simple way by mounting a unit at a certain distance from a point P on the ring. The unit is placed in the path where the compacted material falls off the ring, descending towards the draw-in zone in such a way that the unit is hit by agglomerates formed during operation at an angle $\alpha$ between 60° and 120°, where $\alpha$ is the angle between the surface of the unit and the direction of incidence of the material.

During the grinding process the impact and distribution units will break down agglomerates, while distributing the loosened material down over the draw-in zone in an even layer. The maximum degree of impact is attained when the material hits the surface of the unit at an angle between 70° and 110°.

The units do not need to have a solid surface it might be an advantage that the units have a perforated surface or consist of a grating.

If the material is fed symmetrically via openings at both ends of the grinding ring, agglomeration of material may occur mainly at the middle of the grinding ring and, therefore, the impact and distribution units may be appropriately configured in such a way that they break down agglomerates, while diverting the majority of the material out towards the sides of the grinding ring.

The invention will now be explained in further details with reference to the drawing, where FIG. 1 shows a cross-section through a ring roller mill FIG. 2A–D shows different configurations of the impact and distribution units, viewed both from the side where the material hits the plate and cut through lengthways of the beam 8.

The mill in FIG. 1 has a grinding ring 1 and a roller 2. The roller 2 and the grinding ring 1 rotate by means of a not shown driving mechanism and the roller 2 is thrust against the grinding ring 1 through a tensioning system. Between the roller 2 and the grinding ring 1, the partially crushed material constitutes a grinding bed 4 and the space 4*a* in front of the roller, from which the feed material is drawn in for compaction, is referred to as the draw-in zone.

After the loose material from the draw-in zone has passed under the roller, the material will normally be compacted into a solid mass which is retained on the ring up to a point P where the material starts to drop down towards the draw-in zone.

The position of P will inter alia depend on the speed of the grinding ring and the type of material being ground.

A unit 3*a* is placed in the mill in the path where the compacted material descends towards the draw-in zone. The unit may, for example, be fastened by means of a beam 8 crosswise of the mill in such a way that it is possible to adjust the vertical position of the unit and the angle at which the ground material hits the surface of the unit, and this may, for example, be achievable by tilting or turning the unit. The position of the unit and the angle to vertical can be adjusted from the outside, which means that the position of the unit can be adjusted while material is being ground in the mill. In order to fulfil its purpose to an optimum the impact unit or the first of the impact units should be placed at least ¼×d, preferably more than ⅓×d, away from P, where d is the internal diameter of the grinding ring.

The unit 3*a* will break down agglomerates, and distribute the loosened material across the roller 2 and the draw-in zone 4*a*.

The units 3*b* and 3*c* show alternative positions in the mill, and, if appropriate, several units can be installed simultaneously, either side by side or vertically offset, thereby making it possible to enhance the precision of distribution of the ground material.

Figure 2A:
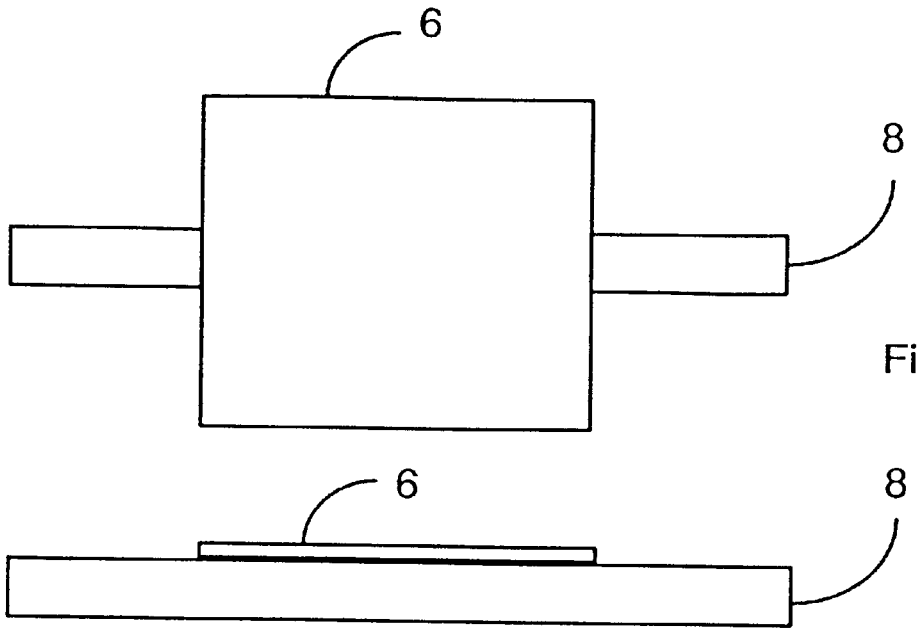

In FIG. 2A is shown a unit configured as a plane plate 6 which does not distribute the material in any specific direction, but merely disperses the material and breaks down agglomerates.

Figure 2B:
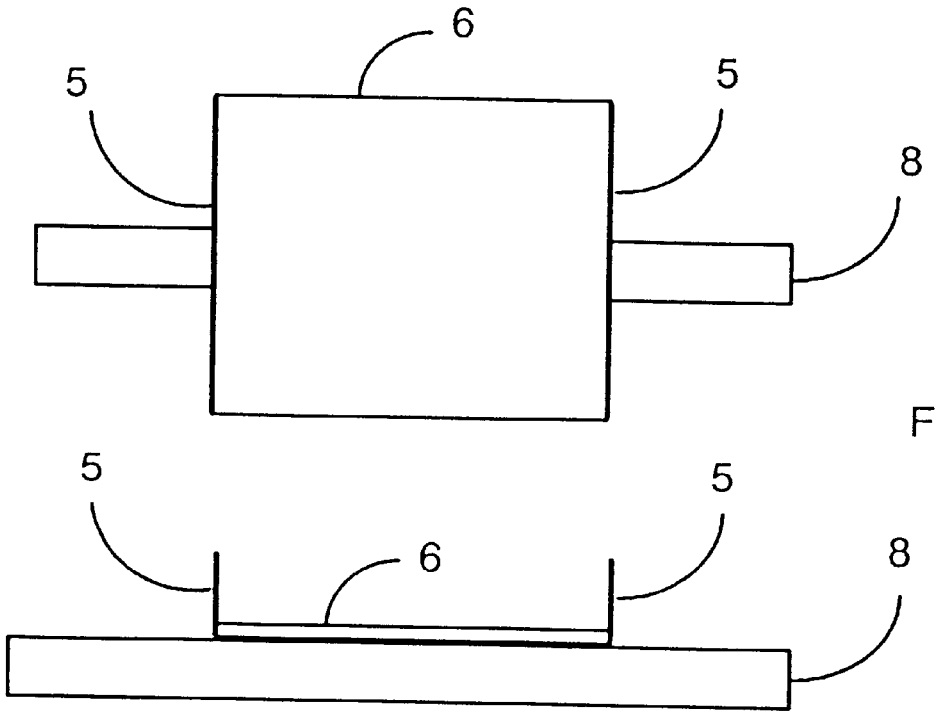

In FIG. 2B is shown a unit configured as a plane plate 6 with end sections 5. The end sections ensure that the dispersion of the material which hits the unit is restricted axially and that the material is directed downwards towards the draw-in zone. The axial extent of such a plate will typically correspond to the roller width.

Figure 2C:
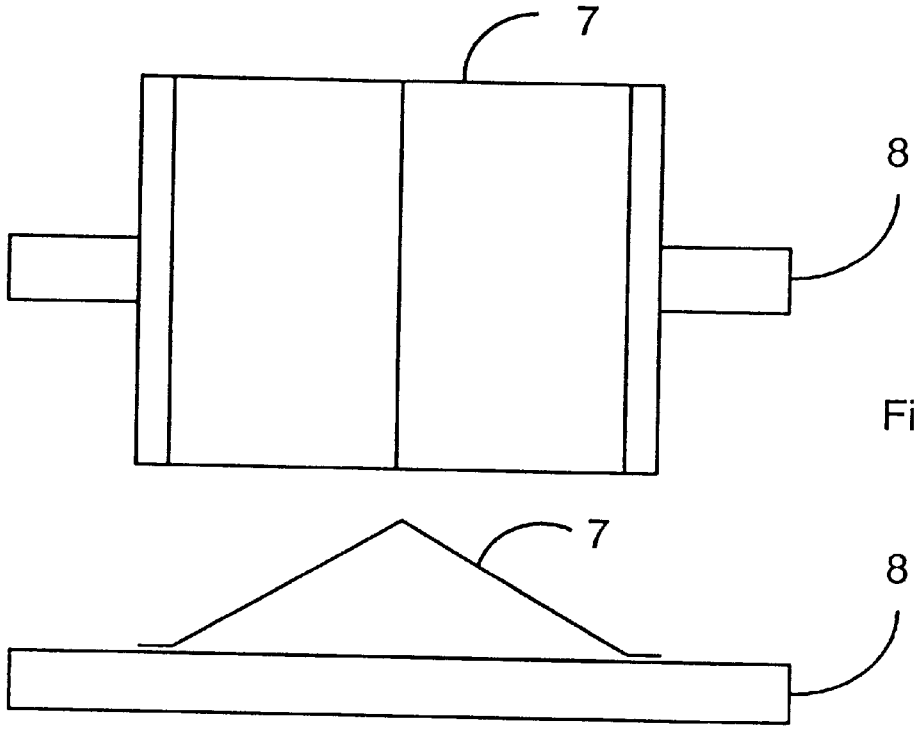
Figure 2D:
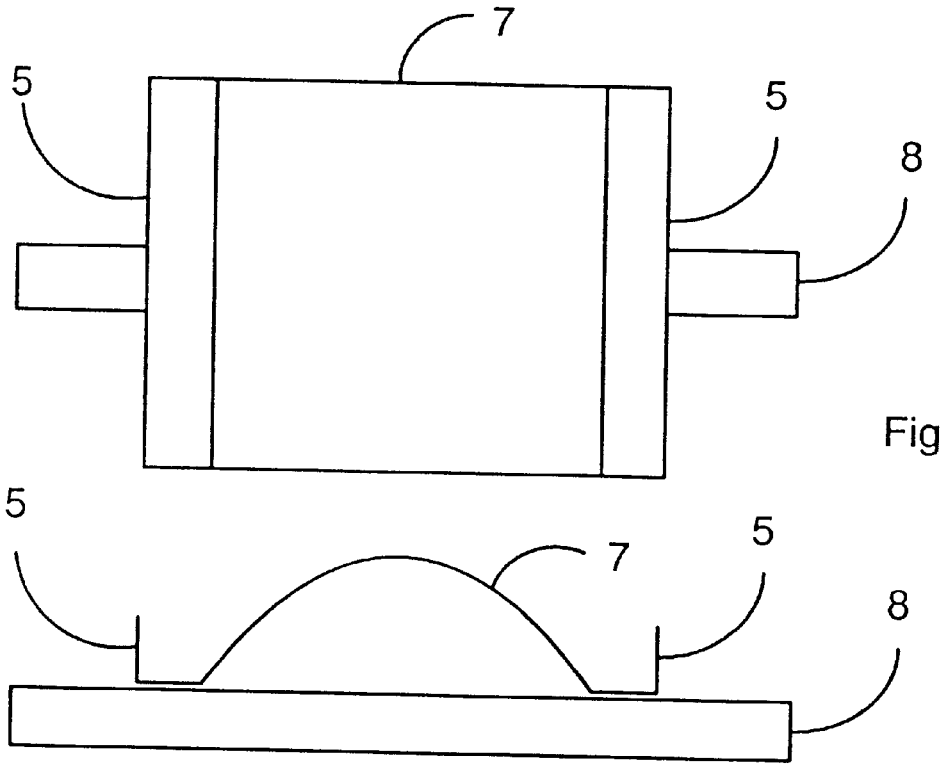

In FIGS. 2C and 2D is shown a unit configured with a raised area 7 which in FIG. 2C has a form which roughly resembles that of a roof ridge. In this configuration, the material is distributed from the middle of the grinding ring and out towards the sides, which is appropriate when there is a tendency of the material being deposited in the middle of the grinding ring during the grinding process.

The size of a unit, cf. FIG. 2C or 2D, i.e. the axial extent, is a contributory factor in determining what the final finished material curve will look like, since the size will be of significance in regard to the number of times the material is recirculated in the mill. A small roof ridge will thus result in a flat particle distribution curve because of the same materials being subjected to several rolling passes without intermediate separation, whereas a wider roof ridge will result in a greater mixture and hence a more effective separation and a steeper particle size distribution curve.

When material is to be ground in a ring roller mill as the one showed in FIG. 1 according to the invention the material is fed to the mill via one or several inlet ducts through one or both of the stationary units which are installed at the end of the grinding ring 1 and directed to the draw-in zone where it is drawn under the roller 2 and subjected to grinding action. Gradually as the amount of ground material increases, the material is thrust over the edge of the grinding ring 1 where it is collected and either recirculated for renewed grinding in the mill or directed, for example while entrained in an airstream, out through the stationary ends at the end of the grinding ring 1 of the mill for renewed processing elsewhere, if appropriate.

I claim:

1. A method for grinding of material in a ring roller mill which mill comprises at least one grinding ring, at least one roller fitted in the grinding ring and at least one unit fitted between the roller and the grinding ring comprising the steps of operating the mill at a subcritical speed and at a grinding pressure above 40 MPa, placing the unit in the path where compacted material is released from the ring at a certain distance from a point P, which is the point on the ring where the material is released, in such a way that the unit is hit by agglomerates formed during operation at an angle between 60° and 120°, said angle being between the surface of the unit and the direction of incidence of the material, after the latter is released from the grinding ring, and distributing the loosened material is distributed over a draw-in-zone in front of the roller and over the roller.

2. A method according to claim 1, including adjusting the grinding pressure between 60 MPa and 100 MPa.

3. A method according to claim 1, including adjusting a angle between 70° and 110°.

4. A method according to claim 1, 2 or 3, characterized in that the distance between the point P and the unit is at least d/4, where d is the internal diameter of the ring.

5. A method according to any one of claim 1–3, characterized in that the unit is configured as at least one plate.

6. A method according to claim 5, characterized in that the unit consists of a plurality of vertically offset plates.

7. A method according to any one of claims 1–3, characterized in that that at least one area on one or several of the units is raised in relation to the surface of a plate so that the majority of the material which hits the unit is directed towards the draw-in zone and roller axially offset in relation to an impact point of the material on the unit.

8. A method according to claim 7, characterized in that the raised area has a form resembling that of a roof ridge.

9. A method according to any one of claims 1–3 characterized in that the mill has stationary end walls and that the unit is equipped with end sections which are placed outermost on the unit pointing in the direction of the stationary end walls.

* * * * *